United States Patent [19]

Ahmed et al.

[11] 4,177,658

[45] Dec. 11, 1979

[54] METHODS AND APPARATUS FOR CONTINUOUS EXTRUSION

[75] Inventors: Nazeer Ahmed, Tumkur, India; Francis J. Fuchs, Jr., Princeton Junction, N.J.

[73] Assignee: Western Electric Co., Inc., New York, N.Y.

[21] Appl. No.: 913,761

[22] Filed: Jun. 8, 1978

[51] Int. Cl.[2] ..... B21B 27/00; B21B 45/02; B21C 23/32

[52] U.S. Cl. ..... 72/60; 72/262; 72/91

[58] Field of Search ..... 72/262, 270, 253, 273, 72/60, 91-93; 164/423, 428; 425/224

[56] References Cited

U.S. PATENT DOCUMENTS

| | | | |
|---|---|---|---|
| Re. 28,795 | 5/1976 | Fuchs | 72/60 |
| 958,010 | 3/1910 | Richards | 72/91 |
| 1,017,943 | 2/1912 | Akin | 164/423 |
| 1,217,748 | 2/1917 | Greenfield | 72/91 |
| 1,986,072 | 1/1935 | Schlaa | 72/91 |
| 3,466,911 | 9/1969 | Marcovitch | 72/91 |
| 3,666,331 | 5/1972 | Curtis et al. | 308/72 |
| 3,740,985 | 6/1973 | Fuchs | 72/60 |
| 3,765,216 | 10/1973 | Green | 72/262 |
| 3,872,703 | 3/1975 | Green | 72/262 |
| 3,881,540 | 5/1975 | Kavesh | 164/276 |
| 3,881,542 | 5/1975 | Polk et al. | 164/276 |
| 3,911,705 | 10/1975 | Voorhess | 72/270 |
| 3,922,898 | 12/1975 | Voorhess | 72/262 |
| 3,985,011 | 10/1976 | Fuch | 72/262 |
| 4,041,745 | 8/1977 | Moreau | 72/60 |
| 4,094,178 | 6/1978 | Fuchs | 72/60 |

FOREIGN PATENT DOCUMENTS

| | | | |
|---|---|---|---|
| 2373339 | 7/1978 | France | 72/262 |

OTHER PUBLICATIONS

*Wire Journal;* Jul. 1975; pp. 73-80, by Avitzur "Extrolling; Combined Extrusion and Rolling."

*Primary Examiner*—Leon Gilden
*Assistant Examiner*—D. M. Gurley
*Attorney, Agent, or Firm*—A. S. Rosen; B. W. Sheffield

[57] ABSTRACT

An annular groove (35) is located in an outer surface of an inner toroid (31), and is partly covered by an inner surface of an outer toroid (32). Alternatively, an annular groove (25) is located in an inner surface of an outer toroid (22), and is partly covered by an outer surface of an inner toroid (21). As the toroids are rotated together about different, intersecting axes, an elongated workpiece (W) is introduced into an open portion of the annular groove, advances into the closed portion of the annular groove, and is extruded through a die (48) upon again approaching the open portion of the annular groove, thereby forming an elongated product (P).

10 Claims, 3 Drawing Figures

METHODS AND APPARATUS FOR CONTINUOUS EXTRUSION

BACKGROUND OF THE INVENTION

1. Field of the Invention

The invention relates to methods and apparatus for deforming a workpiece and, more particularly, to methods and apparatus for the continuous extrusion of an elongated workpiece, such as a rod, of indefinite length to form an elongated product, such as a wire, of indefinite length.

2. Description of the Prior Art

In the art of deforming elongated workpieces of indefinite length, so as to form elongated products of indefinite length, continuous hydrostatic extrusion techniques are known. For example, U.S. Pat. Nos. 3,740,985 and 3,985,011 to F. J. Fuchs, Jr., the former of which has been reissued as U.S. Pat. No. Re. 28,795, disclose two embodiments of apparatus, and related methods, for the continuous hydrostatic extrusion of elongated products of indefinite length. These embodiments incorporate moving trains of gripping element sectors for applying forces to workpieces of indefinite length through suitable shear-transmitting media. In each of these embodiments, a workpiece is advanced linearly, due to the action of shear forces transmitted by the medium utilized, while being subjected to a pressure gradient increasing in the direction of the linear advance. Once the pressure level has become sufficient to increase workpiece ductility substantially, the workpiece is forced through a die which deforms the workpiece into an elongated product.

It is also known to extrude an elongated product of indefinite length by advancing an elongated workpiece of indefinite length along a curved path toward and through a die, utilizing a single rotary member having a grooved, radially outermost surface. The workpiece is held in the groove of the rotary member by a stationary member located radially outwardly from the rotary member. The contact area between the workpiece and the groove in the rotary member is greater than that between the workpiece and the stationary member, so that an imbalance of friction forces causes the workpiece to advance with the rotary member. Such techniques are disclosed in U.S. Pat. No. 3,765,216 and U.S. Pat. No. 3,872,703, both issued to D. Green.

With particular reference to the extrusion technique disclosed in the two Green patents, the use of a stationary member to engage a workpiece and maintain the workpiece within a groove in a rotary member necessarily imposes upon the workpiece a frictional resistance, due to the contact with the surface of the stationary member, which opposes the advance of the workpiece toward the die. This is clearly a source of inefficiency in the extrusion process. Moreover, such a process does not readily permit the provision of efficient mechanisms for supporting a continuously increasing compressive pressure to which the advancing workpiece is subjected during hydrostatic extrusion of the workpiece.

A technique which seeks to overcome the frictional resistance problem associated with the extrusion process taught in the Green patents is disclosed in U.S. Pat. No. 3,911,705 to W. G. Voorhees. The Voorhees approach utilizes a flexible band between the stationary member and the workpiece, the band being permitted to advance with the rotary member and the workpiece, and having a lubricant on the surface of the band which contacts the stationary member in order to minimize the frictional drag on the workpiece. However, no mechanism is available in such an arrangement for providing an effective seal about the edges of the band so as to prevent entry of lubricant into the groove in the rotary member, such as might cause contamination and/or rod slippage, and so as also to prevent flash metal extrusion about the periphery of the band at high pressures. Moreover, the use of a relatively thin, flexible band maintained in tension limits the maximum extrusion pressure which the apparatus can support.

Two further processes, which are of some interest in connection with the continuous deformation of an elongated workpiece of indefinite length, so as to form an elongated product of indefinite length, are disclosed in U.S. Pat. No. 3,922,898 to W. G. Voorhees, and in an article by Betzalel Avitzur entitled, "Extrolling: Combining Extrusion and Rolling", in the July 1975 issue of *Wire Journal* at page 73. Each of these publications discloses the provision of two circular blocks or rolls, which are mounted on parallel axes such that their radially outermost surfaces cooperate to define a region therebetween for gripping an elongated workpiece. Simultaneous rotation of the two circular blocks or rolls causes an elongated workpiece extending tangentially into such region to advance tangentially therewith, so as to be extruded through a suitably positioned die which projects into the path of the advancing workpiece. In addition, the Avitzur article describes a rolling operation taking place as the workpiece is advanced between the rolls and into the die, such article also describing the presence of a protrusion on the radially outermost surface of one of the rolls, mated with a groove on the radially outermost surface of the other roll to form the workpiece gripping region. Clearly, the length of contact between the workpiece and the circular blocks or rolls is relatively limited in systems of this general type, and consequently, the maximum extrusion pressure which can be imparted to the advancing workpiece is similarly limited.

A technique for the continuous hydrostatic extrusion of an elongated workpiece of indefinite length, in order to form an elongated product of indefinite length, is disclosed in a copending application, Ser. No. 664,611, filed Mar. 8, 1976 by F. J. Fuchs, Jr., now U.S. Pat. No. 4,094,178, issued June 13, 1978. Such techniques employs a first rotor having an annular groove in a radially extending surface, and a second rotor which is so mounted for rotation about an axis, differing from an axis of rotation of the first rotor, that a radially extending surface of the second rotor covers a portion only of the annular groove in the first rotor. As the two rotors are rotated together in a like direction of rotation, an elongated workpiece, which advantageously has been coated with a hydrostatic medium, is introduced into the uncovered portion of the annular groove, is transported through the covered portion of the annular groove, and exits from the covered portion of the annular groove by passing through an extrusion die to form an elongated product. The second rotor is preferably mounted with a slight tilt toward the location of the extrusion die in order to support a pressure gradient in the elongated workpiece and its coating which increases as the elongated workpiece advances within the covered portion of the annular groove toward the extrusion die. Such apparatus is considered to overcome various limitations in certain of the previously described prior art apparatus and methods.

Clearly, however, it would be quite advantageous to provide other improved apparatus and methods for deforming an elongated workpiece of indefinite length so as to produce an elongated product of indefinite length, which improved apparatus and methods avoid the previously mentioned shortcomings of certain of these prior art techniques.

SUMMARY OF THE INVENTION

The invention contemplates the continuous deformation of an elongated workpiece of indefinite length to produce an elongated product of indefinite length by introducing the elongated workpiece into a first portion of an annular groove in one of two mating surfaces, the two mating surfaces being an outer surface of an inner toroid and an inner surface of an outer toroid. The inner and outer toroids have respective axes which intersect at such an angle that a second portion of the annular groove is covered by the mating surface which does not include the annular groove while the first portion of the annular groove is not covered by the mating surface which does not include the annular groove. By rotating the inner and outer toroids simultaneously about their respective axes, in an appropriate direction of rotation, the elongated workpiece may be advanced from the first portion of the annular groove into the second portion of the annular groove, and then into a deforming agency as the advancing, elongated workpiece again approaches the second portion of the annular groove. The deforming agency, which is preferably an extrusion die, deforms the elongated workpiece, which is preferably coated with a hydrostatic medium, into an elongated product of indefinite length.

DETAILED DESCRIPTION

Figure 1:
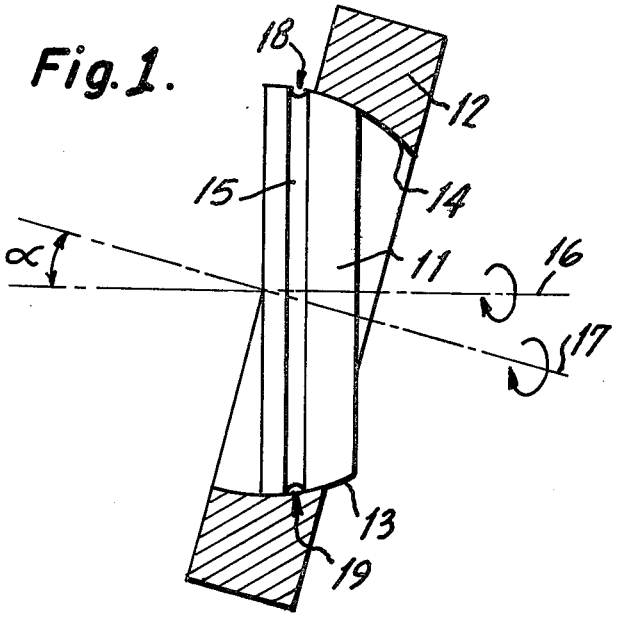
FIG. 1 of the drawing is a schematic illustration, partly in section, showing a geometrical arrangement consisting of an inner and an outer toroid, the toroids being so configured that an outer surface of the inner toroid and an inner surface of the outer toroid constitute mating surfaces, with the inner toroid including an annular groove along its outer surface, and with the inner and outer toroid having respective axes which intersect at such an angle that the annular groove is partly covered, and partly uncovered, by the inner surface of the outer toroid.

Referring initially to FIG. 1 of the drawing, an inner toroid 11 and an outer toroid 12 are illustrated, the outer toroid 12 being shown in section. The inner toroid 11 is received within the outer toroid 12 such that an outer surface 13 of the inner toroid 11 and an inner surface 14 of the outer toroid 12 constitute mating surfaces. An annular groove 15 extends about the outer periphery of the inner toroid 11. A fixed axis 16 of the inner toroid 11 and a fixed axis 17 of the outer toroid 12 intersect at such an angle $\alpha$, e.g., 3 degrees for an inner toroid 11 with an outer diameter of 12 inches, that a first portion 18 of the annular groove 15 is not covered by the inner surface 14 of the outer toroid 12, while a second portion 19 of the annular groove 15 is covered by the inner surface 14 of the outer toroid 12. This relationship will not be altered upon rotation of the two toroids 11 and 12 about their respective axes 16 and 17.

Figure 2:
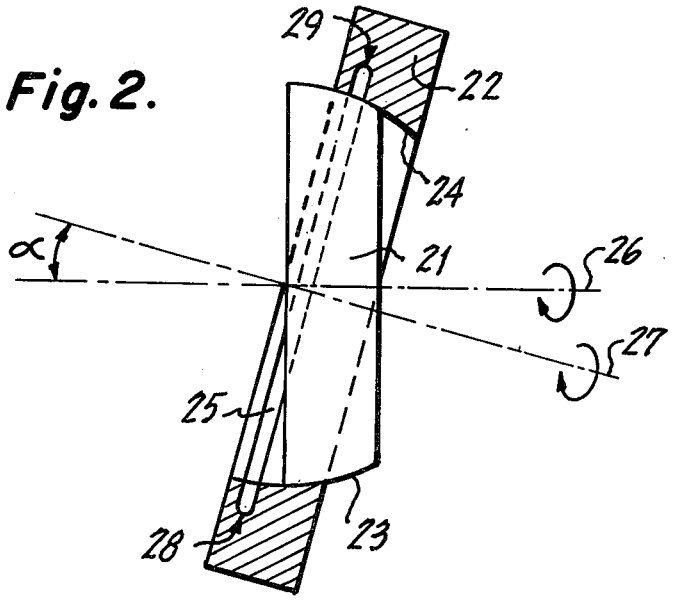
FIG. 2 is a schematic illustration, partly in section, showing a geometrical arrangement consisting of an inner and an outer toroid, similar to the arrangement of FIG. 1 but having the annular groove located in the inner surface of the outer toroid and partly covered, and partly uncovered, by the outer surface of the inner toroid.

Turning now to FIG. 2 of the drawing, an inner toroid 21 and an outer toroid 22 are illustrated, the outer toroid 22 being shown in section. The inner toroid 21 and the outer toroid 22 are substantially similar, respectively, to the inner toroid 11 and the outer toroid 12 shown in FIG. 1. Thus, the inner toroid 21 is received within the outer toroid 22 such that an outer surface 23 of the inner toroid 21 and an inner surface 24 of the outer toroid 22 constitute mating surfaces. The arrangement of FIG. 2 differs from that in FIG. 1 in that an annular groove 25 extends about the inner periphery of the outer toroid 22, rather than about the outer periphery of the inner toroid 21. Thus, since the angle $\alpha$ is again present at the intersection of respective, fixed axes 26 and 27 of the inner and outer toroids 21 and 22, a first portion 28 of the annular groove 25 is not covered by the outer surface 23 of the inner toroid 21, while a second portion 29 of the annular groove 25 is covered by the outer surface 23 of the inner toroid 21. This relationship will not be altered upon rotation of the two toroids 21 and 22 about their respective axes 26 and 27.

Figure 3:
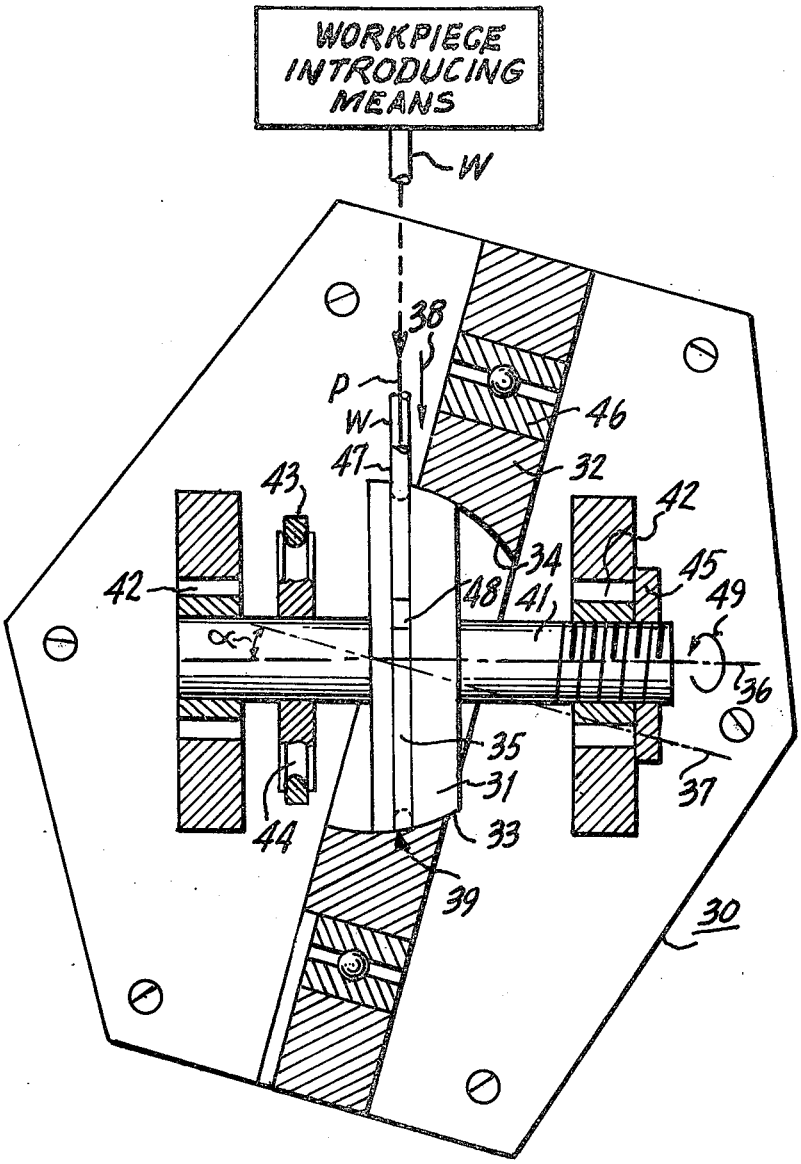
FIG. 3 is a plan view of apparatus constructed in accordance with the principles of the invention for continuously deforming an elongated workpiece of indefinite length to produce an elongated product of indefinite length, the apparatus including an inner toroid and an outer toroid in a geometrical arrangement of the type illustrated in FIG. 1.

Referring next to FIG. 3 of the drawing, an apparatus 30 is adapted for the continuous deformation of an elongated workpiece W of indefinite length, e.g., a metallic rod in either heated or unheated condition, to produce an elongated product P of indefinite length, e.g., one or more metallic wires. The apparatus 30 includes an inner toroid 31 and an outer toroid 32 (the outer toroid 32 being shown in section in FIG. 3), which are substantially identical, respectively, to the inner toroid 11 and the outer toroid 12 shown in the arrangement of FIG. 1. Alternatively, however, the geometry could be substantially identical to that shown in the arrangement of FIG. 2, as will be explained more fully below.

The inner toroid 31 is received within the outer toroid 32 such that an outer surface 33 of the inner toroid 31 and an inner surface 34 of the outer toroid 32 constitute mating surfaces. An annular groove 35 extends about the outer periphery of the inner toroid 31. The toroids 31 and 32 are so mounted, as will be set forth in greater detail below, that a fixed axis 36 of the inner toroid 31 and a fixed axis 37 of the outer toroid 32 intersect at the angle $\alpha$. Thus, a first portion 38 of the annular groove 35 is not covered by the inner surface 34 of the outer toroid 32, while a second portion 39 of the annular groove 35 is covered by the inner surface 34 of the outer toroid 32. This relationship will not be altered upon rotation of the two toroids 31 and 32 about their respective axes 36 and 37.

The axis 36 of the inner toroid 31 is fixed along the center line of a shaft 41 upon which the inner toroid 31 is mounted. The shaft 41 is rotatable in two bearings 42,42 upon being driven, e.g., by a belt 43 which engages a pulley 44 mounted on the shaft 41. A plate 45 is threaded onto one end of the shaft 41, and serves to retain the inner toroid 31 within the outer toroid 32. The axis 37 of the outer toroid 32 is fixed along an axis of a ball bearing 46 which surrounds the outer toroid 32 and which permits rotation of the outer toroid 32 about the axis 37 caused, e.g., by frictional forces along the mating surfaces 33 and 34 of the driving, inner toroid 31 and the driven, outer toroid 32, respectively. A die stem 47 projects into the annular groove 35 in the outer surface 33 of the inner toroid 31 from a location adjacent to the uncovered, first portion 38 of the annular groove 35. The die stem 47 supports at its end an extrusion die 48 which extends at least partly into the covered, second portion 39 of the annular groove 35.

The operation of the apparatus 30 of FIG. 3 will now be described. With the inner toroid 31 and the outer toroid 32 rotating simultaneously about their respective axes 36 and 37 in the direction of arrow 49, upon rotation of the drive pulley 44 and the shaft 41, the elongated workpiece W is fed into the uncovered, first portion 38 of the annular groove 35 in the inner toroid 31. The elongated workpiece W, which has preferably been coated with a suitable hydrostatic medium, e.g., a wax, may enter the first portion 38 of the annular groove 35 beneath the die stem 47. The two rotating toroids 31 and 32 cooperate to advance the elongated workpiece W up and around from the first portion 38 of the annular groove 35 into the covered, second portion 39 of the annular groove 35, and then into the die 48 as the advancing, elongated workpiece W again approaches the first portion 38 of the annular groove 35. Th elongated workpiece W passes through one or more suitable apertures in the die 48 and then exits through the die stem 47 as the elongated product P.

Alternatively, by substituting the arrangement of FIG. 2 into the apparatus 30 of FIG. 3 in place of the arrangement of FIG. 1, the elongated product P might be continuously formed by passing the elongated workpiece W through an annular groove in an outer one of two mating toroids, similar to the toroids 21 and 22, and out through a suitable extrusion die.

It is to be understood that the described methods and apparatus are simply illustrative of preferred embodiments of the invention. Many modifications may, of course, be made in accordance with the principles of the invention.

I claim:

1. A method of continuously deforming an elongated workpiece of indefinite length to produce an elongated product of indefinite length, the method comprising the steps of:

(a) introducing the elongated workpiece into a first portion of an annular groove in one of two mating surfaces, the two mating surfaces being an outer surface of an inner toroid and an inner surface of an outer toroid, the inner and outer toroids having respective axes which intersect at such an angle that a second portion of the annular groove is covered by the mating surface which does not include the annular groove while said first portion of the annular groove is not covered by said mating surface which does not include the annular groove;

(b) rotating the inner and outer toroids simultaneously about their respective axes, in such direction of rotation that the elongated workpiece is advanced from said first portion of the annular groove into said second portion of the annular groove, and then into a deforming agency as the advancing, elongated workpiece again approaches said first portion of the annular groove; and (c) so deforming the elongated workpiece within the deforming agency as to produce an elongated product of indefinite length.

2. A method as set forth in claim 1, wherein step (a) comprises:

(d) introducing the elongated workpiece into a first portion of an annular groove in said outer surface of the inner toroid.

3. A method as set forth in claim 1, wherein step (a) comprises:

(d) introducing the elongated workpiece into a first portion of an annular groove in said inner surface of the outer toroid.

4. A method as set forth in claim 1, wherein said deforming agency comprises an extrusion die, the method further comprising a preliminary step of:

(d) coating an outer periphery of the elongated workpiece with a hydrostatic medium.

5. A method of continuously deforming an elongated workpiece of indefinite length to produce an elongated product of indefinite length, the method comprising the steps of:

(a) introducing the elongated workpiece into a first portion of an annular groove in an outer surface of an inner toroid, the inner toroid being mounted within an outer toroid having an inner surface configured to mate with the outer surface of the inner toroid, the inner and outer toroids having respective axes which intersect at such an angle that a second portion of the annular groove is covered by the inner surface of the outer toroid while said first portion of the annular groove is not covered by the inner surface of the outer toroid; and (b) rotating the inner and outer toroids simultaneously about their respective axes, in such direction of rotation that the elongated workpiece is advanced from said first portion of the annular groove into said second portion of the annular groove, and then into a deforming agency as the advancing, elongated workpiece again approaches said first portion of the annular groove; and (c) so deforming the elongated workpiece within the deforming agency as to produce an elongated product of indefinite length.

6. A method as set forth in claim 5, wherein said deforming agency comprises an extrusion die, the method further comprising a preliminary step of:

(d) coating an outer periphery of the elongated workpiece with a hydrostatic medium.

7. Apparatus for continuously deforming an elongated workpiece of indefinite length to produce an elongated product of indefinite length, the apparatus comprising:

an inner toroid;

an outer toroid having an inner surface configured to mate with an outer surface of said inner toroid, one of said mating surfaces including an annular groove;

means mounting the inner and outer toroids for rotation, with an axis of the inner toroid and an axis of the outer toroid intersecting at a central plane of the outer toroid intersecting at such an angle that a first portion of said annular groove is not covered by the mating surface which does not include the annular groove while a second portion of the annular groove is covered by said mating surface which does not include the annular groove;

means, located adjacent to said first portion of the annular groove, for introducing the elongated workpiece of indefinite length into the first portion of the annular groove;

means for rotating the inner and outer toroids simultaneously about their respective axes, in such direction of rotation that the elongated workpiece is advanced from said introducing means into said second portion of the annular groove; and means, located to receive the advancing, elongated workpiece within said second portion of the annular groove, for so deforming the advancing, elongated workpiece as to produce an elongated product of indefinite length.

8. Apparatus as set forth in claim 7, wherein said annular grove is located in the outer surface of said inner toroid.

9. Apparatus as set forth in claim 7, wherein said annular groove is located in the inner surface of said outer toroid.

10. Apparatus for continuously deforming an elongated workpiece of indefinite length to produce an elongated product of indefinite length, the apparatus comprising:

an inner toroid having an annular groove in an outer surface thereof;

an outer toroid having an inner surface configured to mate with said outer surface of the inner toroid;

means mounting the inner and outer toroids for rotation, with an axis of the inner toroid and an axis of the outer toroid intersecting at such an angle that a first portion of said annular groove in the inner toroid is not covered by said inner surface of the outer toroid while a second portion of the annular groove is covered by the inner surface of the outer toroid;

means, located adjacent to said first portion of the annular groove, for introducing the elongated workpiece of indefinite length into the first portion of the annular groove;

means for rotating the inner and outer toroids simultaneously about their respective axes, in such direction of rotation that the elongated workpiece is advanced from said introducing means into said second portion of the annular groove; and means, located to receive the advancing, elongated workpiece within said second portion of the annular groove, for so deforming the advancing, elongated workpiece as to produce an elongated product of indefinite length.

* * * * *

UNITED STATES PATENT OFFICE

CERTIFICATE OF CORRECTION

PATENT NO. : 4,177,658

DATED : December 11, 1979

INVENTOR(S) : N. AHMED-F. J. FUCHS, JR.

It is certified that error appears in the above-identified patent and that said Letters Patent are hereby corrected as shown below:

On the title page, under References Cited, column 2, "Fuch" should read --Fuchs--. In the specification, column 2, line 48, "techniques" should read --technique--. Column 5, line 30, "Th" should read --The--. Column 5, line 46, "I claim:" should read --What is claimed is:--.

Signed and Sealed this

*Eighteenth* Day of *March 1980*

[SEAL]

*Attest:*

SIDNEY A. DIAMOND

*Attesting Officer*

*Commissioner of Patents and Trademarks*